US005547421A

United States Patent [19]

Scheetz

[11] Patent Number: 5,547,421

[45] Date of Patent: Aug. 20, 1996

[54] ENVIRONMENTALLY CONTROLLED STORAGE CONTAINERS

[76] Inventor: Scott Scheetz, R.R. 1, Box 209, Hamilton, Ill. 62341

[21] Appl. No.: 372,342

[22] Filed: Jan. 13, 1995

[51] Int. Cl.[6] ..... F24F 7/00

[52] U.S. Cl. ..... 454/250; 206/335; 454/118

[58] Field of Search ..... 206/335; 454/79, 454/88, 118, 237, 250, 259, 274, 359, 370

[56] References Cited

U.S. PATENT DOCUMENTS

| | | | |
|---|---|---|---|
| 1,448,307 | 3/1923 | Loup | 454/259 X |
| 2,462,952 | 3/1949 | Dunkak . | |
| 3,813,896 | 6/1974 | Lebartn | 454/195 X |
| 4,242,112 | 12/1980 | Jebens | 55/269 |
| 5,344,363 | 9/1994 | Pollock | 454/259 X |

*Primary Examiner*—Harold Joyce
*Attorney, Agent, or Firm*—Joseph W. Holloway

[57] ABSTRACT

A breathing type storage housing is exposed night and day to fluxuating outdoor air temperature. The housing defines a substantially sealed container of air that is alternately warmed and cooled by heat transferred through the housing due to daytime solar warming and nighttime cooling of the housing. Pressure responsive valves connect the container to the outside of the housing and are operable in response to temperature and pressure fluxuations inside the container for exhalation of warmed air from the container and for inhalation of cooled air into the container from outside the housing. Cooling of the air inside the container is purposely retarded whereby the operation of the valve for connecting the container to the outside of the housing for inhalation is delayed until the outdoor air temperature has decreased sufficiently to condense water vapor out of the outside air.

12 Claims, 2 Drawing Sheets

ENVIRONMENTALLY CONTROLLED STORAGE CONTAINERS

BACKGROUND OF THE INVENTION

This invention, in its broadest aspect, pertains to the utilization of naturally occurring variations in ambient outdoor temperature to reduce water vapor in the air inside a storage container the contents of which may suffer damage or deterioration should such water vapor condense thereupon.

The dehumidifier construction disclosed herein is operable to vent air from inside a storage container when such air is heated and expanded in response to the natural daytime rise in ambient temperature and to admit outside air into the container when the air inside is cooled and contracted in response to the natural nighttime drop in ambient temperature. If there is no temperature differential between air inside and outside the container, a balanced pressure condition exists and no air will be forced either into or out of the container through its vents. Cyclic or reversible air flow as described above is commonly characterized as a breathing action or respiratory function of the container.

Housings of this type which exhibit breathing action are disclosed in a Solar Activated Dehumidifier described in U.S. Pat. No. 2,462,952 issued to Dunkak and in a Solar Powered Dehumidifier Apparatus described in U.S. Pat. No. 4,242,112 issued to Jebens. These prior art dehumidifiers are of a passive class which utilize a dessicant, such as dried silica gel, to absorb water from ambient air before it is inhaled into a closed housing. Such preconditioning of ambient air by means of a dessicant prior to inhalation into a housing is preferred over the well-known refrigerating class of dehumidifiers which consume large quantities of power in order to maintain the temperature and vapor density of air inside the housing at critical levels which forstall unwanted condensation on the housing walls and on objects disposed inside the housing. Nonetheless, both Dunkak and Jebens cite the relatively high energy consumption and cost involved in periodic reactivation of dessicant material by conventional electric heating elements and fueled burners. To overcome this energy related shortcoming of dessicant type air dryers, the aforenoted inventors propose that solar radiation be used as the sole or primary heat source for releasing accumulated moisture from their respective dessicant bodies. Both of these prior art devices also utilize that air periodically exhaled from the heat-pressurized housing interior as a source of purging air to convey moisture from the dessicant body to ambient.

While passive dehumidifiers employing solar activated dessicants to precondition breathing air for a housing appear to display some operating cost advantage over air refrigerating dehumidifiers, several shortcomings remain.

The need for prolonged solar exposure restricts the choice of location of the dessicant body to a normally sunny site; and, since the dessicant body and the housing it serves are usually physically attached or in close proximity, the choice of a less sunny location for the housing, itself, may be unavailable.

To reactivate a body of dessicant material by solar heating, the dessicant material must be subjected to temperatures in excess of 300° F. for a drying period related to the mass of the dessicant body. To assure that solar heating is sufficient to cause the dessicant to give up its accumulated moisture, both Dunkak and Jebens suggest that special lenses or mirrors be positioned between the dessicant body and the sun to concentrate solar rays to effect superheating of the dessicant. Solar tracking apparatus for maintaining the most advantageous position of the lenses has also been proposed. Obviously, association of such auxilliary devices with the dehumidifier apparatus would result in higher initial cost and ongoing structural vulnerability to adverse outside conditions such as wind, rain, hail and airborne particulates.

Where a dehumidifier depends exclusively upon periodic exposure to direct sunlight for proper maintainence of one of its most critical operating elements, i.e. its dessicant body, such a device may be only marginally efficient on a partly cloudy day; moreover, after a succession of cloudy days, the dessicant will likely become fully saturated and the dehumidifier will fail altogether. Provision of an oversized dessicant body will provide a margin of safety against dessicant failure but with accompanying increases in dessicant cost, bulkiness and reactivation time. Moreover, where uncertainty regarding the frequency and duration of sunlight renders the risk of dessicant failure absolutely unacceptable, a standby, conventionally powered dehumidifier must be kept ready in case of such failure thereby defeating in large part the major purpose of a passive dehumidifier.

If the volume of a housing to be dehumidified were sizable, as would be the case for a box-like container dimensioned for storing an automobile, a substantial mass of dessicant material would be required to dry efficiently such a large volume of air to be inhaled into the housing. Provision of ample dessicant would be expensive; and, the bulk of the required dessicant body would be cumbersome to install initially and to replace from time to time as required. Likewise, a storage space suitably sized to accommodate the dessicant body would significantly increase the overall size and cost of the dehumidifier apparatus.

The foregoing recitation of the problems which remain in the construction and application of conventional passive dehumidifier devices of the respiratory type suggests that a substantial change in concept and design is needed to provide an improved passive dehumidifier which exhibits these surprisingly different characteristics and capabilities:

1. No air drying agent such as dessicant material is required.
2. Preconditioning of inhaled air is independent of the availability of sunlight as a reliable source of radiant energy.
3. Daily respiration of the housing can be managed so that inhalation and exhalation occur only as and when outside air conditions favor efficient dehumidification of the housing.

SUMMARY OF THE INVENTION

A general object of this invention is to provide a passive dehumidifier for a breather type housing which overcomes the aforementioned shortcomings of prior art devices intended for this purpose.

A primary object of this invention is to provide a housing which inhales air from the surrounding atmosphere only after some part of the water vapor in such air has been removed naturally due to atmospheric cooling below the dew point. This object is essentially achieved by insulating the housing and by providing air pressure responsive valve means for controlling air flow into and out of the housing interior. The purpose of the insulation means is to cause cyclic temperature fluxuations occurring inside the housing to lag antecedent cyclic temperature fluxuations occurring naturally outside the housing. Because the commencement of nighttime cooling of air inside the housing from an elevated daytime temperature is delayed by the housing insulation means, commencement of inhalation of ambient air is delayed accordingly until the housing air cools and contracts sufficiently to draw additional ambient air through the flow control means into the housing. Prior to commencement of such purposely delayed inhalation, the outside air temperature will have fallen below the dew point; and, accordingly, the somewhat drier outside air thereafter drawn in can be thought of as having been favorably preconditioned, i.e. dehumidified by natural means prior to inhalation.

Another aspect of this invention is the provision of a sealed housing communicating to the outside through pressure responsive inlet and outlet valve means that regulate inhalation and exhalation of air to and from the housing interior. To this end, the outlet valve is normally closed but opens to allow exhalation whenever positive housing air pressure only slightly exceeds ambient air pressure; however, the normally closed inlet valve opens to allow inhalation only after the housing air pressure is reduced to a predetermined and preset point below ambient air pressure.

Exhalation of air along with unwanted water vapor from the housing will occur whenever the volume of air inside the housing expands due to its being heated sufficiently to create an internal housing air pressure sufficient to overcome the threshhold resistance to opening of the outlet valve means. Heat effective to raise the housing air pressure is produced by solar heating of the ambient air and the subsequent transfer of such heat by convection and conduction to and through the insulated walls of the housing to the volume of air inside the housing. If the housing is situated to receive direct sunlight, radiant solar energy will also be absorbed by the housing and transferred to the inside air.

As indicated above, a key feature of this invention is achieved by purposely delaying inhalation of ambient air into the housing until ambient temperature has dropped below the dew point whereby the absolute humidity of the inhaled air will be reduced. To extend further that period of the delay before inhalation achieved by insulating the housing, the threshhold opening pressure of the inlet valve means may be adjusted to have a somewhat greater value than some anticipated ambient air pressure at which inhalation would otherwise commence.

A further aspect of this invention is the utilization of yet another means for delaying the nighttime cooling of the air inside the housing whereby inhalation occurs only after ambient air has been predried naturally by nighttime cooling down to the dewpoint. This additional means comprises a heat absorbant body disposed inside the housing; and, since the housing of this invention is primarily intended as a storage container, the required body may conveniently and, somewhat surprisingly, comprise the stored item or items per se. To the extent that a stored object acts as a body capable of receiving and releasing heat, it functions as a heat sink which absorbs heat over a daylight period and later radiates such heat back to the surrounding air inside the housing. Since the absorbed heat is not dissipated instantaneously and since the air inside the housing and the insulation about the housing are poor heat conductors, the heat sink effect of a large, metallic item, such as an automobile, for example, comprises another means for achieving beneficial delay in inhalation.

Yet another object of this invention is to provide a simple valve means which permits pressure induced breathing by a closed container or housing in the manner and for the purposes stated hereinbefore, yet prevents diffusion of ambient water vapor into the housing when ambient air pressure and the housing air pressure are in equilibrium.

Other specific objects are to provide passively dehumidified storage means which may include some or all of the following advantageous features:

No dessicant or other air-drying agent need be employed or reconditioned.

No energy source other that naturally occurring atmospheric warming is required.

The storage means may be sited anywhere out of doors without regard to conditions of sunlight or shade.

The storage means may be located interiorly of a larger structure provided it remains subject to daily fluxuations in outdoor temperature.

The storage means and items placed therein require no inspection or maintenance over long periods of time.

The hereindisclosed means for dehumidification permits the use of large housing structures capable of storing large, bulky items such as automobiles, for example.

These and other advantages and objects of this invention and the manner of obtaining them will become apparent and the invention will be best appreciated and fully understood by having reference to the following detailed description of the invention taken in conjunction with the accompanying drawings.

DETAILED DESCRIPTION OF THE INVENTION

Figure 1:
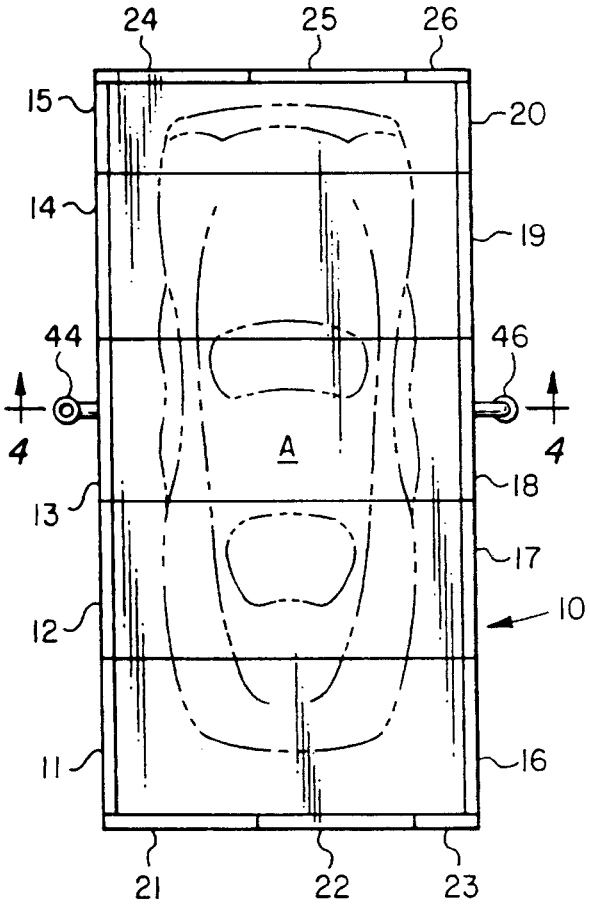
FIG. 1 is a top plan view showing in phantom lines an automobile stored in a housing constructed in accordance with the following disclosure.
Figure 2:
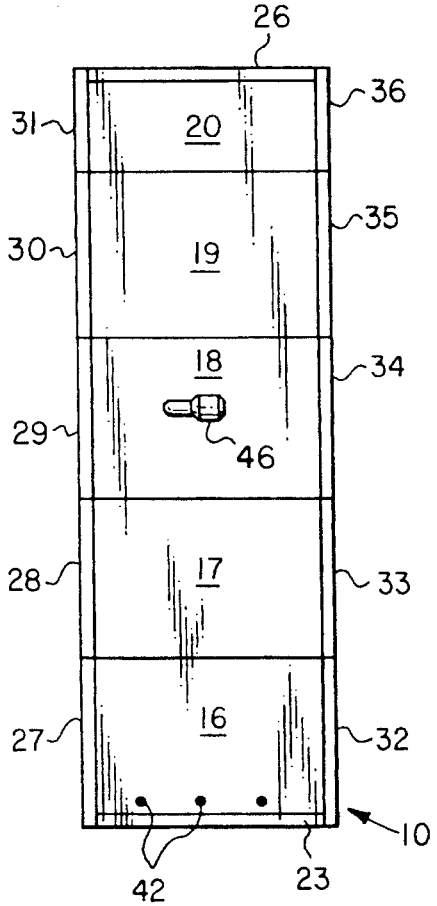
FIG. 2 is a side elevation of the housing shown in FIG. 1.
Figure 3:
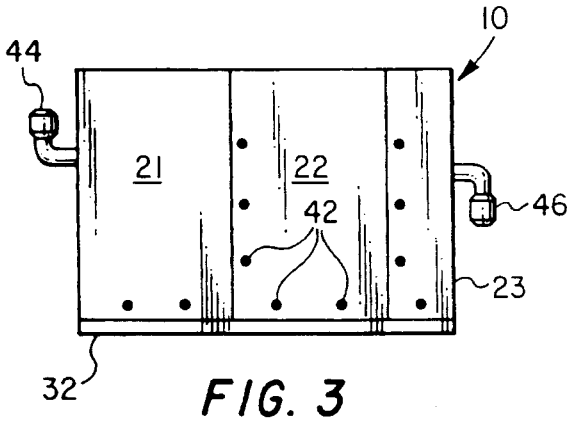
FIG. 3 is a front end elevation of the housing shown in FIG. 1.

The illustrative embodiment of the invention depicted in the drawings comprises a housing or container, indicated generally by numeral 10, made up of upright side wall panels 11 to 20, upright end wall panels 21 to 26, horizontal roof panels 27 to 31, and horizontal floor panels 32 to 36. The walls, roof and floor each comprise an assemblage of these modular panels having tongue and groove edges held in interfitting relationship by internally contained, interlocking cam latches, not shown. Such panels are commercially available and, therefore, do not require further description regarding their structural details or method of assembly.

Figure 4:
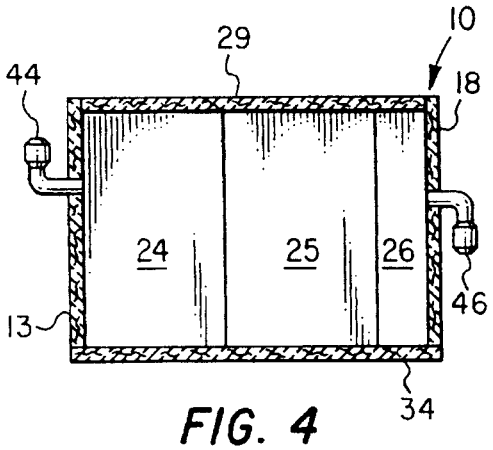
FIG. 4 is a sectional view taken along lines 4'4 of FIG. 1.
Figure 5:
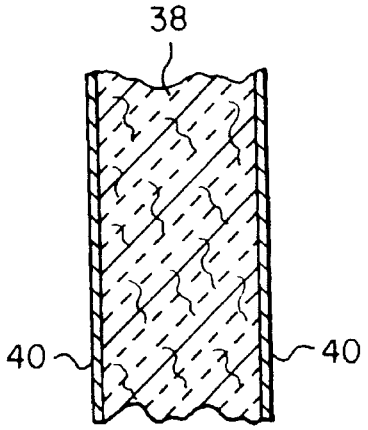
FIG. 5 is an enlarged fragmentary sectional view of a housing panel.
Figure 6:
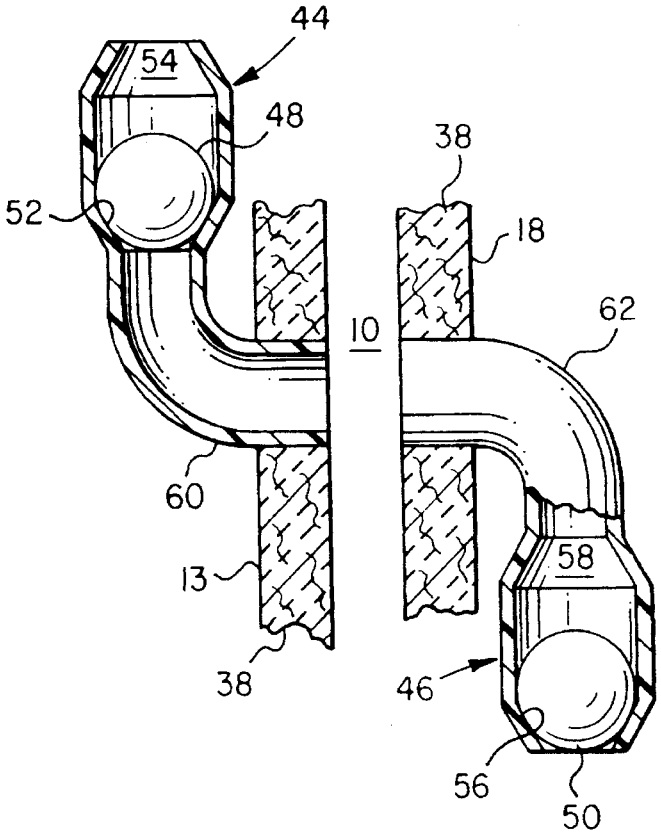
FIG. 6 is an enlarged partial sectional view of the inlet and outlet valves shown in FIGS. 1 through 4.

It is essential for efficient operation of this invention that housing 10 be well insulated and substantially sealed against air leakage. To this end, each of the structural panels is laminated, as shown in FIGS. 4,5 and 6, and comprises core 38 of rigid insulation with thin metallic laminae 40 suitably bonded to its opposite sides. Thermal insulation of this type is commonly extruded of high density polystyrene or polyurethane having a thickness of about three to four inches which provides insulating R valves in the range of R19 to R36. The bonded laminae 40 or skin may comprise 20 to 28 gauge galvanized metal which effectively prevents air from passing through the porous core 38. The tongue and groove joints between all panel edges may be provided with suitable gaskets or joint sealing compound to forestall interpanel leakage. An acceptable alternative housing may be made of other building materials such as plywood, for example, and other insulating materials and insulation installation technics are available. Since the interconnected panels 32 to 34 which make up the housing's floor may be heavily loaded in some applications of this invention, the foam core 38 of these panels may be internally reinforced and the laminae 40 attached thereto may be made of somewhat heavier gage steel.

One beneficial and well-suited application of this invention is suggested in FIG. 1 where an automobile A, depicted in phantom lines, is parked for long term storage inside the aforedescribed housing 10. The appropriate dimensions of the housing will be somewhat greater than those of the automobile in order to facilitate parking and to provide door opening clearance and head room. For example, a housing 10 dimensioned to receive a medium sized car might be 18 feet long, nine feet wide and six feet high in order to provide adequate clearance for the automobile and driver. The standard commercial width of an individual panel employed to fabricate housing 10 is four feet; however, panels 15, 20, 23 26, 31 and 36 have been somewhat reduced in width to provide the housing the desired overall length and width. The aforementioned cam latches inside the panels are operated by an insertable wrench, not shown; and, in the illustrative assemblage, the latches are accessible from the interior of housing 10 for all panels except panels 21, 22 and 23 which make up the front end closure and access means for the housing. Wrench openings 42 through these front end panels and side wall panels 11 and 16 provide exterior access to associated front panel cam latches.

FIG. 6, of the drawings depicts, more or less diagrammatically, a pair of check valves indicated in their entireties by numerals 44 and 46, respectively. Both valves are of the ball check class and rely on the force of gravity acting on lightweight balls 48 and 50 to retain the same in their normally closed or seated condition. Ball 48 closes against the underlying seating surface 52 inside the enlarged cylindrical cavity 54; and, ball 50 closes against a similar seating surface 56 inside the cavity 58. The valves, which may be molded of plastic material, have hollow extensions 60 and 62 mounted through the upright wall panels 13 and 18, respectively, of housing 10 for communication with the housing interior. The curvature of extensions 60 and 62 makes it possible for identical valve constructions to be mounted on the housing to extend vertically in opposite directions. It will be readily understood that rising air pressure inside housing 10 will lift ball 48 for exhalation of housing air through the discharge valve 44 while falling housing air pressure will allow ball 50 to lift to initiate inhalation of outside air into housing 10 through the inlet valve 46. During the period when neither of valves 44 or 46 is operated for lack of an air pressure differential between the housing interior and the air surrounding the housing, the seated ball actuators 48 and 50 check any unwanted diffusion of water vapor into housing 10.

While both valves 44 and 46 function to allow air flow therethrough as a result of small differences between ambient air pressure and housing air pressure, the cracking or opening pressure of the inlet valve 46 may be increased to a pressure higher than that of the outlet valve 44 by increasing the deadweight of ball 50 a selected amount. The desirability of such an adjustment of the operation of valve 46 will be explained hereinafter. While two very simple oneway check valves have been disclosed, it will be apparent that any number of low pressure valves of various constructions are commercially available and can be utilized to control the breathing function of housing 10 in the fashion herein described. The inlet valve 44 may be equipped with a suitable filter or screen, not shown, at the bottom end of the cavity 54 to prevent inhalation of dust or other particulate matter into the housing 10.

Owners of collector and antique automobiles will appreciate that, once isolated inside a housing 10 made according to this invention, such prized and often extremely valuable automobiles will be well protected during long term storage from rodents and insects inhabiting the vehicle, from dirt and dust accumulations on external and internal vehicle surfaces, and from accidental contacts with might dent or scratch the vehicle. Moreover, the insulation inside the housing's structural panels will have the good effect of ameliorating damage to classic finishes and furnishings due to sharp changes in temperature inside the housing and the automobile. Owners of such cars will fully appreciate these recited advantages of housing 10 over less effective practices such as shrouding a stored vehicle with various fabric covers, storing the vehicle in a poorly enclosed shed or storing the vehicle in an unheated garage attached to his home.

Not only is the housing 10 productive of the above enumerated advantages, but it also serves to reduce substantially or eliminate the principal cause of deterioration in stored automobiles, namely, the condensation of water vapor on metal surfaces commonly resulting in destructive electrolytic oxidation or corrosion. Very simply stated, during each daytime period, the sun warms outdoor air which picks up evaporated water as a vapor; and, during each nighttime period as the earth's atmosphere cools, such water vapor condenses when the outdoor air temperature drops to the dew point. Unfortunately, the iron and steel components of an automobile have a low specific heat and, when contacted by nighttime air, tend to cool down more rapidly than their environment. When the air temperature adjacent the automobile reaches the dew point, water vapor in the air condenses and is deposited on its cool surfaces.

Since a storage housing constructed in accordance with this invention is never purged completely of air and water vapor, but rather is of the breather type, an object stored in the housing 10 will always be surrounded by an atmosphere which contains a quantity of moisture in the form of water vapor. If, however, the density of water vapor in the housing is somehow held below the saturated vapor density for a given housing temperature, the dew point will not be reached and unwanted water will not condense. Condensation can likewise be forestalled so long as the housing temperature is maintained above the dew point of the water vapor. This invention contemplates an apparatus having a passive method of operation which suppresses moisture condensation inside the storage housing 10 by managing both housing vapor density and housing temperature in a novel manner yet extremely simple and effective means. Essentially the combined effect of the insulated housing panels and the operation of outlet and inlet valves 44 and 46 conditions the air inside the housing in a manner that the likelyhood that dew will form inside the housing is greatly reduced, if not eliminated.

OPERATION OF THE DISCLOSED EMBODIMENT

An initial advantage for the user of this invention is that a desirable outdoor site for the container 10 may be selected without regard to the availability of direct sunlight. Energy sufficient for carrying out its dehumidifying function will be supplied to the container so long as the air inside the container is cyclically cooled and heated by daytime solar heating and nighttime cooling of the atmosphere surrounding the container. The efficiency of the dehumidifying function should be satisfactory in those geographic regions in which daytime to nighttime temperature differentials are substantial and occur with daily or near daily regularity during all seasons of the year. Good results have been obtained where outside temperatures exhibit variations of at least 20° F. between midnight and noon. Since exposure to direct sunlight is not necessary, although not undesirable, the container 10 or a plurality of similar containers may, if desired, be enclosed inside an available building or structure that provides enhanced physical security against tampering with the container or theft of its contents; provided that the temperature inside such other structure fluxuates substantially in the manner described above and provided that such other structure does not constrain the container's respiratory air flow.

With the automobile A parked in an erected housing 10, the end wall panels 21, 22 and 23 are locked in place to render the enclosed space defined by the container 10 substantially airtight. While the container need not be hermetically sealed to operate effectively, the total air leakage between the assembled structural panels must be so constrained that the respiratory function of the container is not inhibited and so that no more than a minimal amount of water vapor is allowed to enter the container by diffusion.

During daytime hours, i.e. from sunrise to sunset, the earth's atmosphere, including the air mass immediately surrounding the container 10, can be expected to warm gradually to a daytime high. Subsequently, during the nighttime hours, the air about the container 10 will cool off to a minimum temperature sometime after sundown. The well understood effect of this daily temperature fluxuation on the volume of air substantially sealed inside container 10 is an increase in pressure inside the container in response to daytime heating followed by a pressure decrease in response to nighttime cooling. Whenever the air pressure inside the container 10 rises above the threshhold opening pressure of the discharge valve 44, air containing a quantity of water vapor, will be belched through the valve to atmosphere until the internal pressure of the container falls to a level insufficient to lift the deadweight of ball 48. This discharge of air and water vapor may occur frequently during the day until the daytime temperature inside the container reaches its maximum and then begins to cool. As a result of this day-time process of exhausting some of the water vapor from the container, the vapor density of the air remaining inside the container will fall to its lowest daily level and the temperature of the residual water vapor will likely remain well above the dew point during the day.

As ambient temperature begins to cool from a daytime high, the temperature and pressure of the air inside container 10 will remain for some time at a higher level than otherwise would be the case if the walls, roof and floor of the container were not insulated by the core components 38 of the structural panels 11–36. As the heat contained in the warmer inside air is gradually transferred by conduction and convection through the walls of housing components, the inside temperature will begin to fall but only after an antecedent drop in outside temperature. The intended effect of the housing insulation is to create a condition in which the dropping inside temperature will lag behind that outside the container. This lag, intentionally induced by insulating the housing, can be beneficially prolonged by the aforedescribed heat sink effect of the stored automobile, i.e. the heat from this cooling metallic mass is dissipated by radiation to the surrounding inside air to further delay cooling inside housing 10.

After atmospheric cooling causes the inside air to begin to contract due to loss of its daytime acquired heat and dissipation of heat from the automobile mass, the air pressure inside the housing will drop below ambient air pressure and eventually produce a differential pressure across inlet valve 46 capable of lifting the ball 50 upwardly from its seat 56. Outside air will then be lifted through the inlet valve only until the ball 50 subsequently reseats due to rising air pressure inside container 10. During each such inhalation, a volume or gulp of air at ambient water vapor density mixes with that air inside the container to raise incrementally the inside vapor density. It is the main purpose of this invention to delay, by the means described above, the initiation of air inhalation and the resulting mixing of warm inside and cool outside air resulting in a higher inside vapor density and movement of the inside temperature toward the dew point of the air and water vapor mixture in the housing. This objective is achieved in part by delaying the occurrence of conditions inside the housing which cause opening of the inlet valve 46 until the outside air has already cooled enough to produce a significant reduction in vapor density due to a loss of moisture in the form of dew.

In addition to the combined effects of insulating the housing 10 and utilization of heat dissipated from the stored automobile body A, a third distinct but coactive means for retarding inhalation until the outside air is dried by partial condensation of its vapor content is employed in the operation of this invention. The latter means comprises an inlet valve 46 in which the actuator ball 50 has a deadweight that can be overcome by a pressure differential produced only after cooling and contraction of the housing volume has progressed to an extent that outside air temperature has dropped below the dew point and has been dried accordingly. During this delay in inhalation induced by requiring a greater pressure differential to open inlet valve 46, falling pressure inside housing 10 will lower the vapor pressure therein so that vapor condensation is inhibited even though the vapor may be cooling as outside air temperature gradually drops. However, negative housing pressure should not be allowed to fall so far that the seals between the structural components of the housing deteriorate or fail.

While the embodiment illustrated comprises an automobile size container, it will be appreciated that larger or smaller breathing containers can be supplied with preconditioned, predried air by using the structure and method of operation disclosed herein.

The foregoing description of the embodiment of the invention shown in the drawings is illustrative and explanatory only; and, various changes in the size, shape and materials, as well as in specific details of the illustrated construction, may be made without departing from the scope of the invention. Therefore, I do not intend to be limited to the details shown and described herein, but intend to cover all changes and modifications which are encompassed by the scope and spirit of the appended claims.

What I claim as my invention is:

1. Respiratory housing means subjected to natural warming and cooling of ambient air and water vapor;

said housing means defining a substantially sealed volume containing an air and water vapor mixture that is warmed by ambient air and expanded during daytime and cooled by ambient air and contracted during nighttime in response to heat transfer through said housing means;

pressure responsive outlet and inlet valve means connecting said volume with ambient air and water vapor;

said outlet valve being operable in response to warming and expansion of said mixture to exhale the same from said volume;

said inlet valve being operable in response to cooling and contraction of said mixture to inhale ambient air and water vapor into said volume; and, means for delaying operation of said inlet valve until ambient water vapor is condensed by natural cooling.

2. The invention according to claim 1, wherein:

said delaying means includes thermal insulating means.

3. The invention according to claim 2 wherein:

said thermal insulating means surrounds said volume.

4. The invention according to claim 3, wherein:

said thermal insulating means comprises structural components of said housing means.

5. The invention according to claim 2, wherein:

said delaying means includes heat sink means disposed in said volume.

6. The invention according to claim 5, wherein:

said heat sink means comprises a metallic mass temporarily stored in said volume.

7. Method for controlling the environment in a storage container comprising the steps of:

providing a boxlike container;

exposing said container to naturally occurring fluxuations in atmospheric temperature;

placing a body inside said container for storage and thereafter sealing said container to prevent substantial air leakage;

exhaling air and water vapor from said container to atmosphere and inhaling air and water vapor from atmosphere into said housing in response to said fluxuations in atmospheric temperature; and, delaying inhalation of air and water vapor until the atmosphere has cooled to reduce the water vapor contained therein.

8. The method set for in claim 7, wherein:

delay in inhalation is provided by thermally insulating said container.

9. The method set forth in claim 8, wherein:

the heat sink characteristic of said body is also utilized to delay inhalation.

10. The method set forth in claim 7, wherein:

the fluxuation in atmospheric temperature is at least 20° F.

11. The method set forth in claim 8, wherein:

the R valve of the thermal insulation for said container is between R19 and R36.

12. The method set forth in claim 9, wherein:

said body comprises an automobile.

* * * * *